US009045906B1

(12) United States Patent
Richey et al.

(10) Patent No.: US 9,045,906 B1
(45) Date of Patent: Jun. 2, 2015

(54) ROOF OPENING GUARD RAIL SYSTEM

(71) Applicant: Precision Ladders, LLC, Morristown, TN (US)

(72) Inventors: Steven M. Richey, Morristown, TN (US); Roy G. Parton, Pigeon Forge, TN (US)

(73) Assignee: Precision Ladders, LLC, Morristown, TN (US)

( * ) Notice: Subject to any disclaimer, the term of this patent is extended or adjusted under 35 U.S.C. 154(b) by 0 days.

(21) Appl. No.: 14/259,885

(22) Filed: Apr. 23, 2014

(51) Int. Cl.
*E02D 29/14* (2006.01)
*E04D 13/035* (2006.01)
*E04D 13/00* (2006.01)

(52) U.S. Cl.
CPC ..... *E04D 13/0357* (2013.01); *E04D 13/00* (2013.01)

(58) Field of Classification Search
CPC .... E02D 29/127; E04G 21/3204; E04F 11/00
USPC ..... 52/19, 20; 182/113; 256/65.02
See application file for complete search history.

(56) References Cited

U.S. PATENT DOCUMENTS

| | | | | |
|---|---|---|---|---|
| 5,921,531 | A * | 7/1999 | Early | 256/67 |
| 5,941,024 | A * | 8/1999 | Journault | 52/20 |
| 6,681,528 | B1 * | 1/2004 | Profeta et al. | 52/20 |
| 6,830,127 | B2 * | 12/2004 | Johnson | 182/113 |
| 6,931,793 | B2 * | 8/2005 | Joyce et al. | 52/20 |
| 7,516,575 | B2 | 4/2009 | Cuccurullo | |
| 8,256,164 | B2 | 9/2012 | Cuccurullo | |
| 8,517,144 | B2 | 8/2013 | Cuccurullo | |
| 8,632,099 | B2 * | 1/2014 | Conny et al. | 280/837 |

* cited by examiner

*Primary Examiner* — Jeanette E Chapman
*Assistant Examiner* — Daniel Kenny
(74) *Attorney, Agent, or Firm* — Pitts & Lake, P.C.

(57) ABSTRACT

A collapsible safety railing system to be used with a roof-top hatch opening, the hatch opening having a hatch cover to open and close the hatch opening, the system including a plurality of post members configured such that each of the respective post members is pivotally coupled to a point proximate each respective perimeter corner of a base portion of the hatch opening, and such that the post members pivot between a substantially upright position and a closed position, one or more safety rails extending between adjacent ones of the post members on at least two sides of the hatch opening, a gate member provided at a side of the hatch opening at which the safety rails are not provided, and a linkage member to link the hatch cover to the collapsible safety railing system to move the post members to the substantially upright position when the hatch cover is in the open position, and to move the post members to the substantially collapsed position when the hatch cover is in the closed position.

15 Claims, 3 Drawing Sheets

ROOF OPENING GUARD RAIL SYSTEM

FIELD OF INVENTION

The present general inventive concept relates to fall protection devices, and, more particularly, to collapsible devices for providing secure safety railings around roof openings such as hatches, skylights, etc.

BACKGROUND

Fall protection devices such as safety railings have conventionally been provided to hatch openings, such as roof-top hatch openings, to guard against a person falling into a hatch that has been left open out of convenience or carelessness. They also provide handholds to assist people while entering and/or exiting through the hatch opening. However, the conventional safety railings have a problem in that they may be obtrusive, either by way of access of the space above the hatch or aesthetically, such as blighting the view of a rooftop. Therefore, a safety railing that is not present in the same form when not in use may be desired.

BRIEF SUMMARY

The present general inventive concept, in various example embodiments, includes a collapsible safety railing system to be used with a hatch opening, wherein the collapsible safety railing system is linked to a hatch cover so as to be raised to a substantially upright position when the hatch cover is substantially upright, and lowered to a collapsed position when the hatch cover is closed.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a collapsible safety railing system to be used with a roof-top hatch opening, the hatch opening having a hatch cover to open and close the hatch opening, the system including a first base member coupled to a base portion of the hatch opening at a first side of the hatch opening, a second base member coupled to the base portion at a second side of the hatch opening opposite the first side, a plurality of post members coupled to each of the first and second base members, respectively, the post members being pivotally coupled to the first and second base members at coupling points proximate perimeter corners of the base portion such that the post members pivot with respect to the first and second base members between a substantially upright position and a substantially collapsed position, a plurality of side rails pivotally coupled to the post members such that at least one side rail extends between the post members on opposing sides of the hatch opening, a gate member coupled to at least one of the post members and configured to be moved between an open and closed position, and a linkage member to link the hatch cover to the collapsible safety railing system to move the post members to the substantially upright position when the hatch cover is in the open position, and to move the post members to the substantially collapsed position when the hatch cover is in the closed position.

The collapsible safety railing system may further include at least one rear rail extending between the post members that are provided at a rear of the hatch opening.

The linkage member may include a first end pivotally coupled to the at least one rear rail and a second end pivotally coupled to the hatch cover.

The linkage member may include a first end pivotally coupled to at least one of the post members that are provided at a rear of the hatch opening and a second end pivotally coupled to the hatch cover.

The gate member may be a rigid member pivotally coupled to a first post member such that the gate member pivots with respect to the first post member between a closed position in which the gate member extends to a second post member, and an open position when the gate member is moved away from the second post member.

The collapsible safety railing system may further include a latching member to couple the gate member to the second post member in the closed position.

The gate member may be substantially similar in form to the side rails.

The gate member may be a non-rigid member extending from one of the post members at a front of the hatch opening to an adjacent one of the post members.

The collapsible safety railing system may further include extension members provided respectively between the post members at a rear of the hatch opening and the first or second base member respectively coupled to the rear post members so as to provide two pivot points between each of the rear post members and the first or second base member to which the rear post members are coupled.

The first and second base members may be provided respectively at a front and rear of the hatch opening.

The first and second base members may be provided at respective sides of the hatch opening.

The foregoing and/or other aspects and advantages of the present general inventive concept may also be achieved by a collapsible safety railing system to be used with a roof-top hatch opening, the hatch opening having a hatch cover to open and close the hatch opening, the system including a plurality of post members configured such that each of the respective post members is pivotally coupled to a point proximate each respective perimeter corner of a base portion of the hatch opening, and such that the post members pivot between a substantially upright position and a closed position, one or more safety rails extending between adjacent ones of the post members on at least two sides of the hatch opening, a gate member provided at a side of the hatch opening at which the safety rails are not provided, and a linkage member to link the hatch cover to the collapsible safety railing system to move the post members to the substantially upright position when the hatch cover is in the open position, and to move the post members to the substantially collapsed position when the hatch cover is in the closed position.

The safety rails may be substantially rigid members that have non-rigid ends coupled to the corresponding post members.

The safety rails may be non-rigid.

The safety rails may be substantially rigid, and any of the safety rails that extend in a direction away from the hatch cover may be pivotally coupled to the corresponding post members to allow pivotal movement relative to the corresponding post members.

The post members may be pivotally coupled directly to the base portion of the hatch opening.

The collapsible safety railing system may further include base members provided at two or more sides of the base portion of the hatch opening, wherein the post members are pivotally coupled to the base members.

The linkage member may include a first end pivotally coupled to at least one of the post members that are provided at a rear of the hatch opening and a second end pivotally coupled to the hatch cover.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various embodiments of the present general inventive concept, as described herein, provide a collapsible safety railing system to be used with a hatch opening, wherein the collapsible safety railing system is linked to a hatch cover so as to be raised to a substantially upright position when the hatch cover is substantially upright, and lowered to a collapsed position when the hatch cover is closed.

Figure 1:
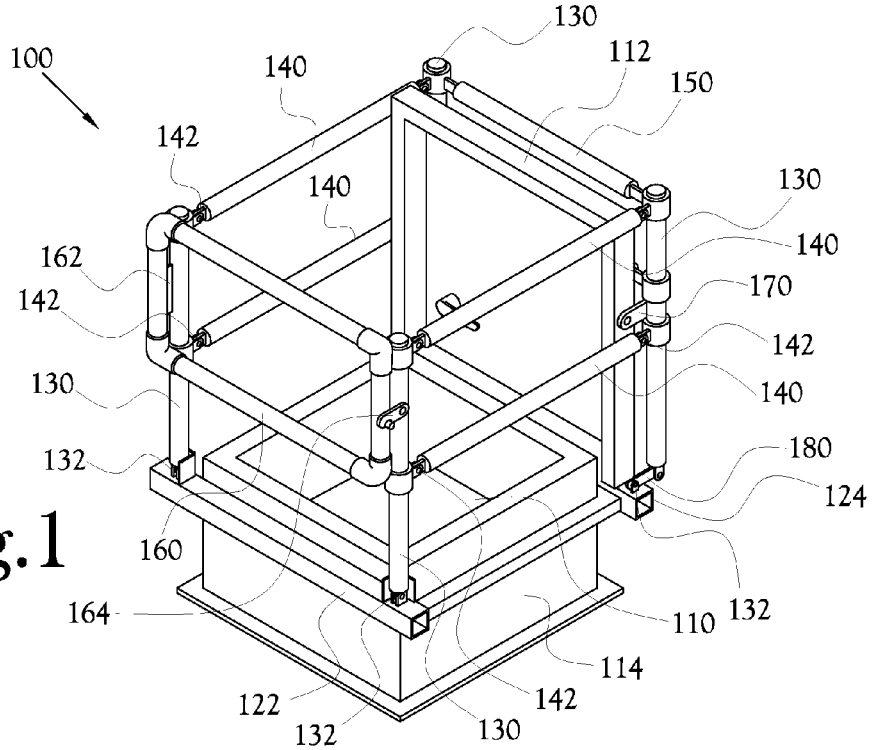
FIG. 1 illustrates an example embodiment of a collapsible safety railing system to be used with a hatch opening according to an example embodiment of the present general inventive concept.

FIG. 1 illustrates an example embodiment of a collapsible safety railing system to be used with a hatch opening according to an example embodiment of the present general inventive concept. The hatch opening 110 illustrated in FIG. 1, and which is generally described herein in regard to different example embodiments of the present general inventive concept, is a roof-top hatch, the hatch opening 110 having a hatch cover 112 and a hatch base 114. Typically, such a hatch base 114 will extend a certain amount above the surface accessed by the hatch opening 110. However, it is understood that the present general inventive concept is not limited to such a roof-top hatch, and may be used with various other hatch openings.

As seen in FIG. 1, which shows the example collapsible safety railing system 100 in a substantially upright position when the hatch cover 112 is opened to a substantially vertical position, the collapsible safety railing system 100 includes a forward base member 122 coupled to the hatch base 114 at a front of the hatch opening 110, and a rear base member 124 coupled to the hatch base 114 at a rear of the hatch opening 110. In various example embodiments, the base members 122,124 of the collapsible safety railing system 100 may be provided at the sides of the hatch base 114 instead of, or in addition to, the forward and rear base members 122,124. Also, in various example embodiments, the base members 122,124 may be coupled to the surface, such as the roof, accessed by the hatch opening 110. The base members 122, 124 may be coupled to the hatch base 114, for example, by a coupling member such as a screw, by welding, by an adhesive body, and the like, or any combination of such coupling members and methods.

The example embodiment of FIG. 1 includes a plurality of corner posts 130 coupled to each of the forward and rear base members 122,124 such that one of the corner posts 130 is coupled to the forward or rear base member 122,124 at a coupling point 132 proximate to each corner of the hatch base 114, each of the corner posts 130 being configured to pivot around the respective coupling points 132 between an upright position and a collapsed position. In other words, a corner post 130 may be located proximate to each corner of the of the hatch opening 110, and may be pivotally connected to the respective front and rear base members 122,124 so as to rotate around that pivotal connection. With such a configuration, the corner posts 130 may be moved from the upright position to a lowered position, as will be illustrated in FIGS. 4-5, which will be described herein. In various example embodiments, the base members 122,124 may be omitted, and the corner posts 130 may be adhered directly to the hatch base 114 or roof surface itself by various types of couplings that allow the corner posts 130 to pivot about the coupling points so as to move between a substantially upright position and a collapsed position. The corner posts 130 may be formed of various materials that are rigid enough to maintain the structure of the collapsible safety railing system 100. For example, the corner posts 130 may be formed of solid and/or hollow metal bodies, various plastics, and so on. The corner posts 130 may be coupled to the front and rear base members 122,124 by any of a number of possible configurations, such as any of various types of hinges or bearings. According to various example embodiments, the corner posts 130 may be formed of the same material as the front and rear base members 122,124.

One or more safety rails or side rails 140 are provided respectively between the corner posts 130 coupled to the forward base member 122 and the corner posts 130 coupled to the rear base member 124 to provide safety railing at the sides of the hatch opening 110. The side rails 140 are pivotally coupled to the corner posts at coupling points 142 at each end of the side rails 140 so that the connection may be maintained while the corner posts 130 are moved from the upright position to the collapsed position, and vice versa. The coupling points 142 may be of the same type of configuration as the coupling points 132 which couple the corner posts 130 to the respective front and rear base members 122,124. In other various example embodiments, the side rails may be coupled to the respective corner posts in a non-pivoting fashion that still allows relative movement between the side rails and the corresponding corner posts, such as, for example, non-rigid portions provided at ends of the side rails, or altogether non-rigid side rails. In the example embodiment shown in FIG. 1, two side rails 140 are provided at each side of the collapsible safety railing system 100, one at the top and one near a mid-point of the corner posts 130. However, the quantity and position of the side rails 140 may be different according to different various example embodiments of the present general inventive concept. Also, as shown in FIG. 1, one or more rear rails 150 may be provided between the corner posts 130 coupled to the rear base member 124 to form a rear railing. In other various example embodiments, the rear rails 150 may be omitted, as the hatch cover 112 may provide its own protection toward undesired access from a direction at the rear of the hatch opening 110.

As shown in FIG. 1, a gate member 160 is provided to extend between the corner posts 130 that are coupled to the forward base member 122. The gate member 160 may be pivotally coupled, such as by a hinge 162, to a first one of the front corner posts 130, and configured to extend to a second one of the front corner posts 130 when in a closed position. According to various example embodiments, a latching member 164 may be provided to the second one of the front corner posts 130 to secure the gate member 160 in the closed position. In other words, the gate member 160 may be a rigid member that may be movable between an open and closed position, and may be formed of the same rigid material as the side rails 140 and/or the corner posts 130. In other various example embodiments, the gate member 160 or other type of front rail/safety member may be formed of a non-rigid material, such as, for example, a chain.

The collapsible safety railing system 100 may be linked to the hatch cover 112 so as to be raised to a substantially upright position when the hatch cover 112 is substantially upright, and lowered to the collapsed position when the hatch cover 112 is closed. As illustrated in FIG. 1, in various example embodiments of the present general inventive concept the collapsible safety railing system 100 may include a connecting member 170 pivotally coupled at a first end to one of the rear corner posts 130, and at a second end to the hatch cover 112, such that the collapsible safety railing system 100 is coupled to the hatch cover 112 to be raised and lowered with the hatch cover 112. In various example embodiments, two such connecting members 170 may be provided, one at either side of the hatch cover 112 and respectively coupled to each of the rear corner posts 130. In other various example embodiments, the connecting member 170 may be pivotally coupled at the first end to at least one of the rear rails 150 in addition to or instead of the rear corner posts 130, or to another portion of the collapsible safety railing system 100.

As illustrated in FIG. 1, the collapsible safety railing system 100 may also be provided with respective extension members 180 between the rear base member 124 and each of the rear corner posts 130, the extension members 180 each being pivotally coupled at respective ends to the rear base member 124 and the rear corner posts 130 so as to provide two pivot points in the coupling between the rear base member 124 and the rear corner posts 130. Such an extension and the provision of two pivoting points may provide more desirable movement of the rear portion of the collapsible safety railing system 100 as the hatch door 112 is opened and closed, due to the fixed position of the rear corner posts 130 and/or rear rails 150 relative to the hatch cover 112 that is created by the connecting member 170 that couples the hatch cover 112 and the safety railing system 100.

Figure 2:
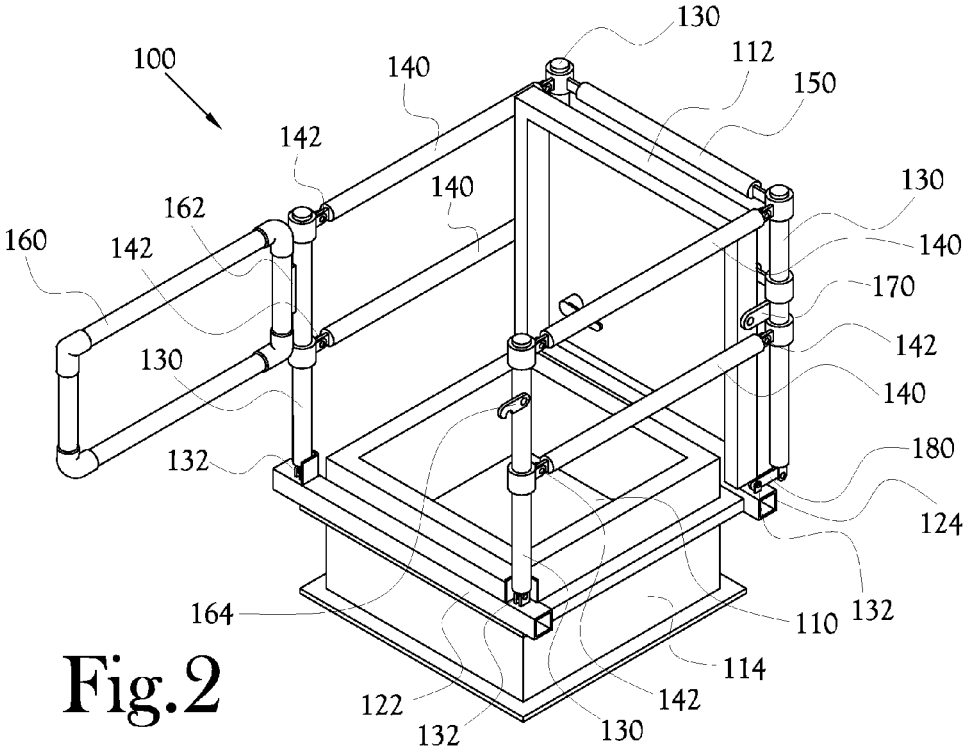
FIG. 2 illustrates the gate member 160 of FIG. 1 in an open position.

FIG. 1 illustrates the example embodiment of the present general inventive concept discussed above in an upright position with the gate member 160 in a closed and latched position. FIG. 2 illustrates the gate member 160 of FIG. 1 in an open position, so that the hatch opening 110 can be accessed.

In various example embodiments of the present general inventive concept in which the collapsible safety railing system 100 is coupled to the hatch cover 112, the system 100 may be collapsed by releasing a catch member, e.g., a cover positioning control arm, of the hatch cover 112, and simply closing the hatch cover 112. In other various example embodiments of the present general inventive concept, a similar catch member may be provided to the collapsible safety railing system 100 itself, to help maintain the upright position of the railing system and hatch cover. Such a catch member may be segmented so as to be lockable in a fully extended position to support the upright position of the collapsible safety railing system 100.

Figure 3:
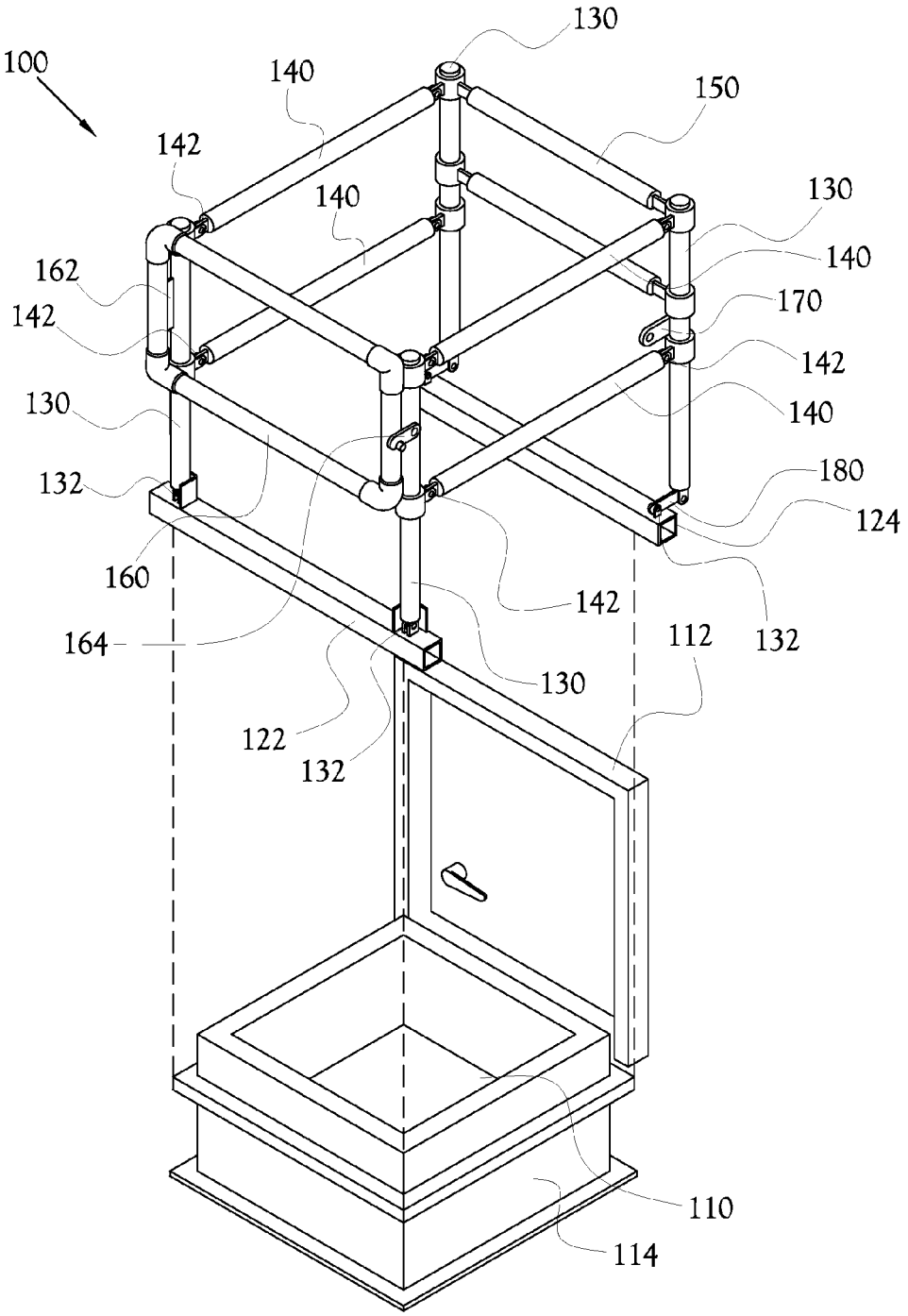
FIG. 3 illustrates a partially exploded view of FIG. 1 in which the collapsible safety railing system is shown separated from the hatch cover and hatch base.

FIG. 3 illustrates a partially exploded view of FIG. 1 in which the collapsible safety railing system 100 is shown separated from the hatch cover 112 and hatch base 114. It is understood that the collapsible safety railing system 100 may be fully assembled before being coupled to the hatch base 114 and/or hatch cover 112, or various components such as the base members 122,124 may be attached to the hatch base 114 before assembling the rest of the collapsible safety railing system 100, and so on.

Figure 4:
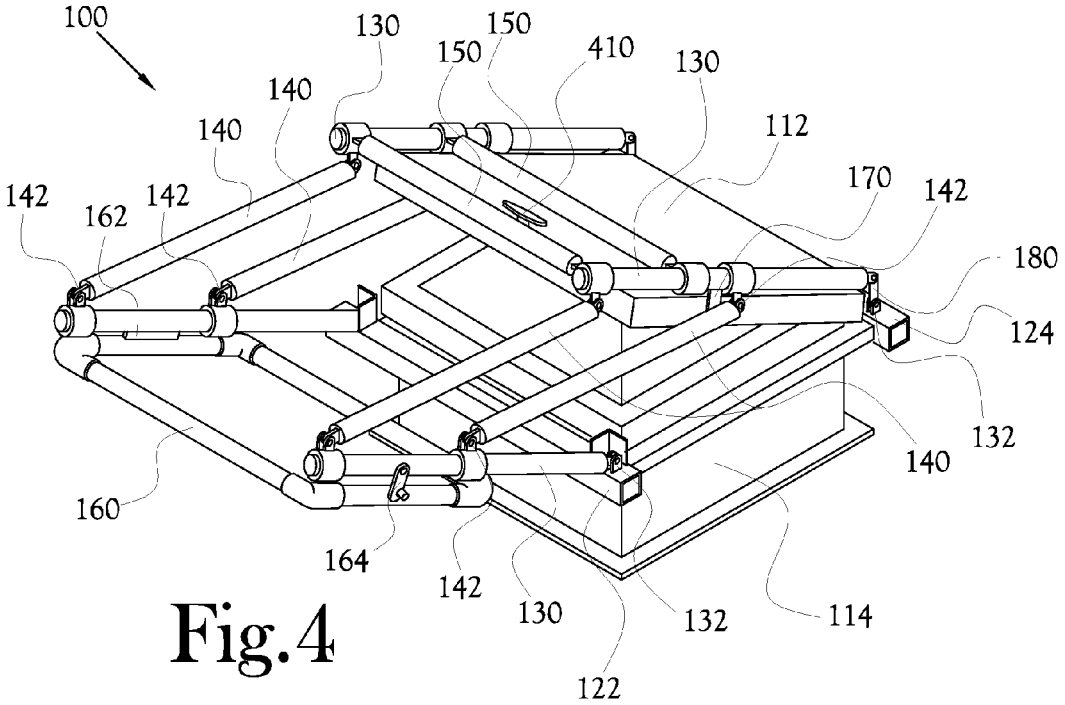
FIG. 4 illustrates the collapsible safety railing system of FIG. 1 in a partially collapsed state.
Figure 5:
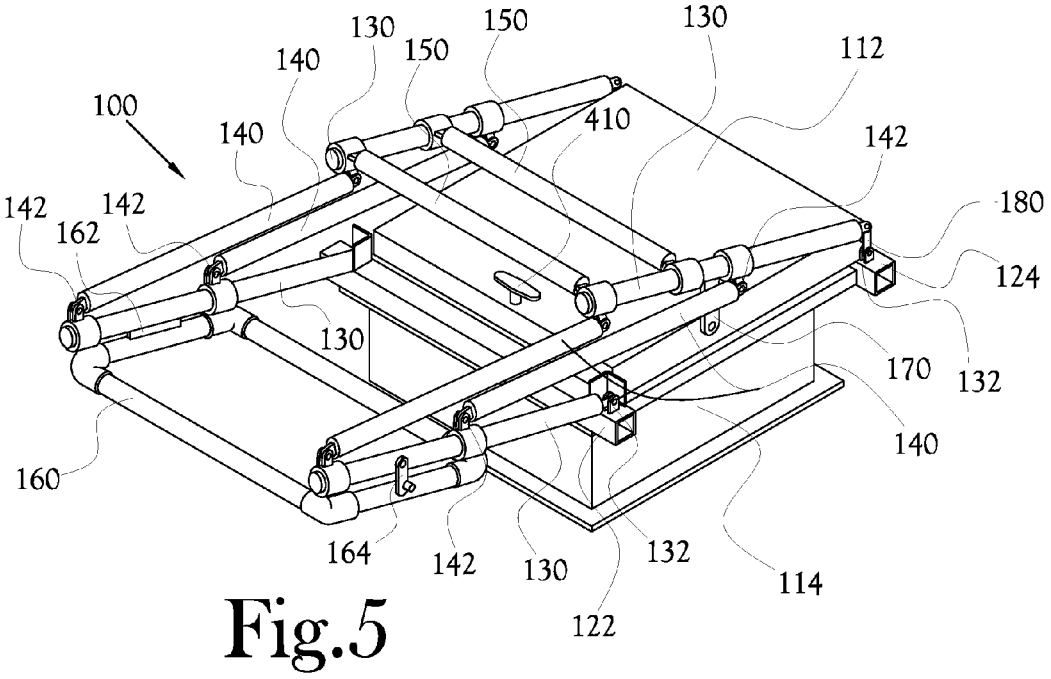
FIG. 5 illustrates the collapsible safety railing system of FIG. 1 in a substantially collapsed state.

FIG. 4 illustrates the collapsible safety railing system 100 of FIG. 1 in a partially collapsed state, and FIG. 5 illustrates the collapsible safety railing system 100 of FIG. 1 in a substantially collapsed state. In various example embodiments of the present general inventive concept in which the system 100 is coupled to the hatch cover 112, a user may collapse the collapsible safety railing system 100 by simply closing the hatch cover 112. For example, a user may simply lower the hatch cover 112 using the hatch cover handle 410, which will begin the collapsing of the system 100 as illustrated in FIG. 4, until the hatch cover 112 is closed and the system 100 is substantially collapsed, as illustrated in FIG. 5. In various other example embodiments, such as those in which the collapsible safety railing system 100 is not coupled to the hatch cover 112, the system 112 may be collapsed, for example, after the closing of the hatch over 112. As illustrated in FIG. 5, very little space above the hatch cover level is occupied by the collapsed safety railing system. In the example embodiment illustrated in FIGS. 1-5, the process of raising the hatch cover 112 and collapsible safety railing system 100 will simply be a reversal of the process of closing the hatch cover 112. In various example embodiments, the collapsible safety railing system may omit the previously described connecting member 170, or provide a connecting member that may be readily disconnected, so that the collapsible safety railing system 100 may be moved between the upright and collapsed positions without a corresponding opening and closing of the hatch door 112.

In various example embodiments of the present general inventive concept, there is provided a collapsible safety railing system to be used with a roof-top hatch opening, the hatch opening having a hatch cover to open and close the hatch opening, the system including a plurality of post members configured such that each of the respective post members is pivotally coupled to a point proximate each respective perimeter corner of a base portion of the hatch opening, and such that the post members pivot between a substantially upright position and a closed position, one or more safety rails extending between adjacent ones of the post members on at least two sides of the hatch opening, a gate member provided at a side of the hatch opening at which the safety rails are not provided, and a linkage member to link the hatch cover to the collapsible safety railing system to move the post members to the substantially upright position when the hatch cover is in the open position, and to move the post members to the substantially collapsed position when the hatch cover is in the closed position.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A collapsible safety railing system to be used with a roof-top hatch opening, the hatch opening having a hatch cover to open and close the hatch opening, the system comprising:

a first base member coupled to a base portion of the hatch opening at a first side of the hatch opening;

a second base member coupled to the base portion at a second side of the hatch opening opposite the first side;

a plurality of post members coupled to each of the first and second base members, respectively, the post members being pivotally coupled to the first and second base members at coupling points proximate perimeter corners of the base portion such that the post members pivot with respect to the first and second base members between a substantially upright position and a substantially collapsed position;

a plurality of side rails pivotally coupled to the post members such that at least one side rail extends between the post members on opposing sides of the hatch opening;

a gate member coupled to at least one of the post members and configured to be moved between an open and closed position; and a linkage member to link the hatch cover to the collapsible safety railing system to move the post members to the substantially upright position when the hatch cover is in the open position, and to move the post members to the substantially collapsed position when the hatch cover is in the closed position.

2. The collapsible safety railing system of claim 1, further comprising at least one rear rail extending between the post members that are provided at a rear of the hatch opening.

3. The collapsible safety railing system of claim 2, wherein the linkage member includes a first end pivotally coupled to the at least one rear rail and a second end pivotally coupled to the hatch cover.

4. The collapsible safety railing system of claim 1, wherein the linkage member includes a first end pivotally coupled to at least one of the post members that are provided at a rear of the hatch opening and a second end pivotally coupled to the hatch cover.

5. The collapsible safety railing system of claim 1, wherein the gate member is a rigid member pivotally coupled to a first post member such that the gate member pivots with respect to the first post member between a closed position in which the gate member extends to a second post member, and an open position when the gate member is moved away from the second post member.

6. The collapsible safety railing system of claim 5, further comprising a latching member to couple the gate member to the second post member in the closed position.

7. The collapsible safety railing system of claim 1, wherein the gate member is substantially similar in form to the side rails.

8. The collapsible safety railing system of claim 1, wherein the gate member is a non-rigid member extending from one of the post members at a front of the hatch opening to an adjacent one of the post members.

9. The collapsible safety railing system of claim 1, further comprising extension members provided respectively between the post members at a rear of the hatch opening and the first or second base member respectively coupled to the rear post members so as to provide two pivot points between each of the rear post members and the first or second base member to which the rear post members are coupled.

10. The collapsible safety railing system of claim 1, wherein the first and second base members are provided respectively at a front and rear of the hatch opening.

11. The collapsible safety railing system of claim 1, wherein the first and second base members are provided at respective sides of the hatch opening.

12. A collapsible safety railing system to be used with a roof-top hatch opening, the hatch opening having a hatch cover to open and close the hatch opening, the system comprising:

a plurality of post members configured such that each of the respective post members is pivotally coupled to a point proximate each respective perimeter corner of a base portion of the hatch opening, and such that the post members pivot between a substantially upright position and a closed position;

one or more safety rails extending between adjacent ones of the post members on at least two sides of the hatch opening;

a gate member provided at a side of the hatch opening at which the safety rails are not provided; and a linkage member to link the hatch cover to the collapsible safety railing system to move the post members to the substantially upright position when the hatch cover is in the open position, and to move the post members to the substantially collapsed position when the hatch cover is in the closed position, wherein the safety rails are substantially rigid, and any of the safety rails that extend in a direction away from the hatch cover are pivotally coupled to the corresponding post members to allow pivotal movement relative to the corresponding post members.

13. The collapsible safety railing system of claim 12, wherein the post members are pivotally coupled directly to the base portion of the hatch opening.

14. The collapsible safety railing system of claim 12, further comprising base members provided at two or more sides of the base portion of the hatch opening, wherein the post members are pivotally coupled to the base members.

15. A collapsible safety railing system to be used with a roof-top hatch opening, the hatch opening having a hatch cover to open and close the hatch opening, the system comprising:

a plurality of post members configured such that each of the respective post members is pivotally coupled to a point proximate each respective perimeter corner of a base portion of the hatch opening, and such that the post members pivot between a substantially upright position and a closed position;

one or more safety rails extending between adjacent ones of the post members on at least two sides of the hatch opening;

a gate member provided at a side of the hatch opening at which the safety rails are not provided; and a linkage member to link the hatch cover to the collapsible safety railing system to move the post members to the substantially upright position when the hatch cover is in the open position, and to move the post members to the substantially collapsed position when the hatch cover is in the closed position, wherein the linkage member includes a first end pivotally coupled to at least one of the post members that are provided at a rear of the hatch opening and a second end pivotally coupled to the hatch cover.

* * * * *